United States Patent [19]

Kaneko et al.

[11] Patent Number: 4,650,348

[45] Date of Patent: Mar. 17, 1987

[54] METHOD OF DOT-PRINTING UNDERLINES

[75] Inventors: Masahiko Kaneko; Masao Kunita; Seiichi Ohsawa, all of Saitama, Japan

[73] Assignee: Citizen Watch Co., Ltd., Tokyo, Japan

[21] Appl. No.: 684,130

[22] Filed: Dec. 20, 1984

[30] Foreign Application Priority Data

Dec. 29, 1983 [JP] Japan ..... 58-247794

[51] Int. Cl.[4] ..... B41J 29/26; B41J 3/12

[52] U.S. Cl. ..... 400/22; 400/54; 400/121

[58] Field of Search ..... 400/22, 54, 121, 124; 101/93.04, 93.05

[56] References Cited

FOREIGN PATENT DOCUMENTS 99688 8/1981 Japan ..... 400/124

118269 7/1983 Japan ..... 400/121

119865 7/1983 Japan ..... 400/22

OTHER PUBLICATIONS

*IBM Tech. Disc. Bulletin,* by B. R. Cavill, vol. 24, No. 11A, Apr. 1982, pp. 5430–5432.

*Primary Examiner*—Paul T. Sewell

*Attorney, Agent, or Firm*—Koda and Androlia

[57] ABSTRACT

A method of dot-printing underline or the like employing a print head and power source with relatively small capacity. The reciprocation of the print head is divided into a plurality of travels by the command of divisional print so that the required underline print is performed by the collected dot prints being printed at intervals on each of a plurality of travels of the print head. A rest time will be provided between each printing actions at intervals of the print head to reduce the capacity of a power source employed for driving the dot pins in the print head.

2 Claims, 5 Drawing Figures

METHOD OF DOT-PRINTING UNDERLINES

BACKGROUND OF THE INVENTION

1. Field of the Invention

The present invention relates to a method of dot-printing underlines and particularly, to an improved method of dot-printing underlines below printed letters, symbols and the like.

2. Description of the Prior Art

There is well-known such a dot printer comprising a print head reciprocatable relative to a recording paper, the print head including a single or plural dot pins which are driven and impacted against the recording paper sequentially in accordance with print commands for a given letter, symbol or the like to form a dot matrix recording corresponding to the given letter on the paper. Particularly, such a print head including a plurality of dot pins arranged to provide a plurality of print rows simultaneously is practically utilized in a high-speed shuttle type dot-line printer.

In such a type of dot printers, each dot pin is driven in accordance with a character font to provide prints such as ordinary letters and the like, for example. There is therefore a relatively large rest time between each adjacent printing actions of the individual dot pin. Driving means or normally solenoid means for each dot pin is of such an operative capacity that anticipates the rest time between each adjacent printing actions. Voltage drop in the power supply also is maintained to a proper value on such conventional printing actions.

Recently, a printer has been proposed which has an additional function as relatively long range continuous printing, for example, printing underlines below printed characters or printing a table. For such an additional underlining function, the dot pin drive must continuously be supplied with drive current. In the prior art systems, this raised a problem in that the power supply required to drive the underlining dot pins did not have enough capacity to prevent the voltage drop, resulting in faulty quality of printed letters.

To overcome such a problem, the prior art systems require a large-capacity power source. This would provide increased dimensions and costs.

SUMMARY OF THE INVENTION

It is therefore an object of the present invention to provide an improved method of dot-printing underlines which enables underlining dot-pins to be driven even by the use of a small-sized and effective source of power.

To attain the above object, the present invention provides an improved dotted-underline printing method characterized by the step of dividing the movement of a print head into a plurality of travels without continuously printing a dotted underline and performing a required underlines by collected dot prints being printed at intervals on each of a plurality of travels of the print head such that a rest time will be provided between each adjacent supplies of the power driving dot pins to reduce the capacity of the power source.

DESCRIPTION OF PREFERRED EMBODIMENTS

Figure 1:
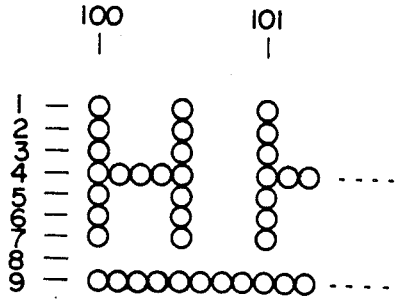
FIG. 1 PRIOR ART
FIG. 1 illustrates an underline printing process in the prior art.

FIG. 1 shows an example of underline printings in the shuttle type dot printers. As be well known in the art, a print head comprises a plurality of dot pins arranged corresponding to positions as indicated by 100, 101. The dot pins are sequentially faced to first through ninth lines to form a desired dot matrix as a recording paper is moved upwardly as viewed in FIG. 1. The first through eighth lines are used to print conventional characters and the like. In FIG. 1, the dot pins are utilized to print a letter "H". The last or ninth line is used to print an underline below the letter.

Figure 2:
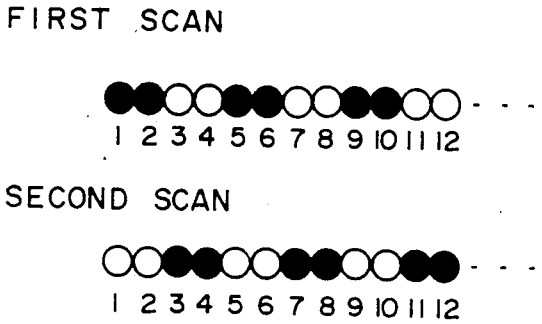
FIG. 2 illustrates an underline printing process in accordance with the method of the present invention.

In accordance with one aspect of the present invention, a print head is driven on the ninth line for underline through a plurality of travels rather than a single full-motion. FIG. 2 shows an example of such printing process.

Referring to FIG. 2, black dots are printed dots. This indicates that dots 1, 2, 5, 6, 9 and 10 are printed through a first travel of the print head. Thereafter, dots 3, 4, 7, 8, 11 and 12 are printed through a second travel of the print head. It is understood that two travels of the print head from a continuous underline collected dot prints being printed at intervals as shown in FIG. 1.

In accordance with the feature of the present invention, an enough rest time is always provided to the underlining dot pins through the two travels of the print head. During this rest time, the voltage of the power supply can sufficiently recovered. Therefore, a relatively small-sized power source can be utilized to print a sufficiently good underline below a given print letter. This also contributes to the reduction of dimensions and costs of printer devices.

The underlining process of the present invention is exceedingly effective especially for printing an underline extending over a plurality of letters. However, if a predetermined number of letters to be underlined is small, for example, five letters, it is more advantageous for high-speed print that an underline is continuously printed without said divisional printing process. In accordance with the method of the present invention, the underlining process may be applied to any continuously straight line such as ruled line and others apart from underlines below printed letters, symbols or the like.

Figure 3:
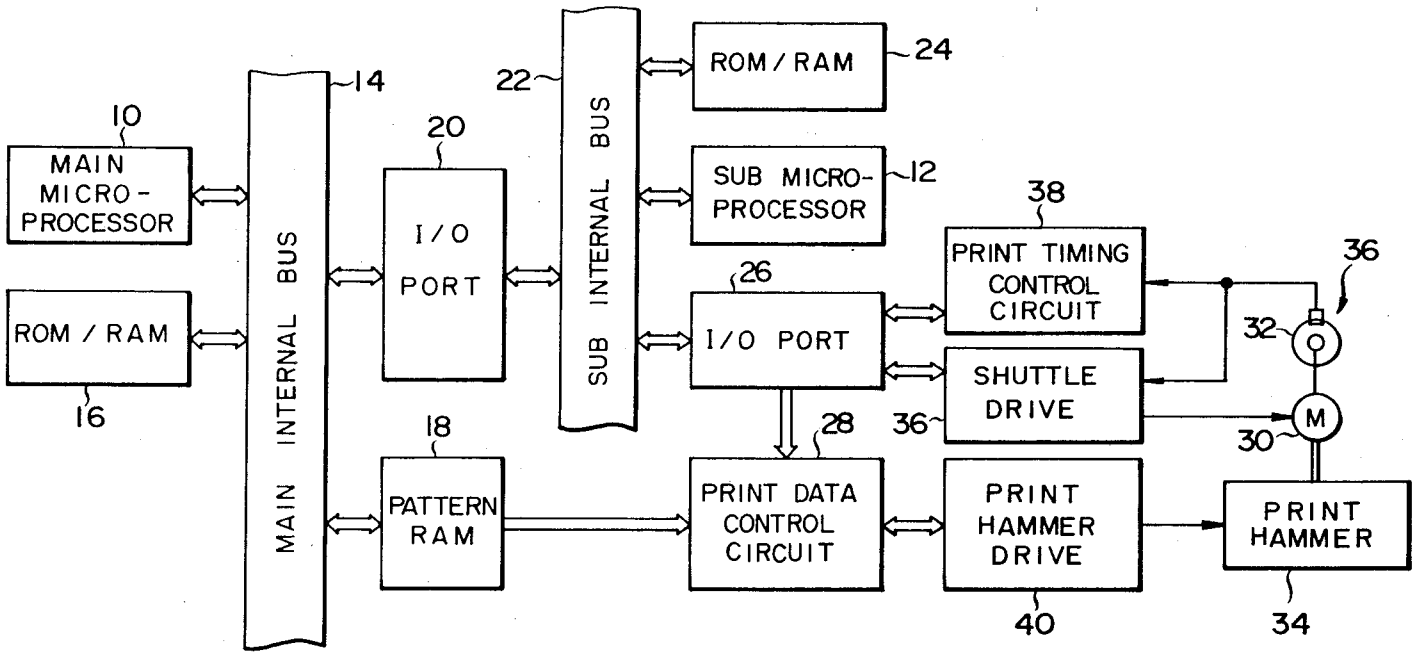
FIG. 3 is a control block diagram in a preferred embodiment of a shuttle type dot printer to which the method of the present invention is applied.

FIG. 3 shows a block diagram of a preferred control circuit which can be used in the printing method of the present invention. The control circuit includes a main microprocessor 10 and a sub-microprocessor 12. The main microprocessor 10 is adapted to buffer store print commands from a host controller in ROM/RAM 16 through a main internal bus 14. The sub-microprocessor 12 controls the actual printing action of the shuttle type dot printer in accordance with the print commands stored by the main microprocessor 10.

As be well known, print commands stored in said ROM/RAM 16 include information of underline print. These print commands are converted for each dot line in accordance with a predetermined character font such that the control of printing will be made by a counter provided in each of the dot lines.

The conversion according to the character font is in fact carried out through a character generator in the ROM/RAM 16. The so formed print pattern is then written in a pattern RAM 18 through the main internal bus 14. Upon completion of the conversion and storage, start command is transferred from the main internal bus 14 to I/O port 20 and to the sub-microprocessor 12 through a sub internal bus 22. The sub-microprocessor 12 is operably connected with a second ROM/RAM 24 through the sub internal bus 22. Print control signals are supplied to a print data control circuit 28 from an I/O port 26. The print data control circuit 28 reads out print data stored in said pattern RAM 18 to start a desired print action.

The details of the shuttle type dot printer will not be described and illustrated since they have been known in the art. Briefly, the printer comprises a shuttle driving motor 30 for reciprocatingly driving the shuttle, a rotary encoder 32 operably connected with the motor 30, and a print hammer 34 for providing an impact to dot pins. The motor 30 receives a drive signal from the I/0 port 26 through a shuttle motor drive circuit 36 such that the travel of the shuttle or print head will be controlled. The divisional print of underline according to the method of the present invention is carried out through the controlled travel of the print head.

The movement of the motor 30 is detected by the rotary encoder 32 through a timing sensor 36. The detected position of the print head is inputted to the I/0 port 26 through a print timing control circuit 38. In this manner, the sub-microprocessor 12 will always receive print timing signals indicative of the position of the print head being moved.

The print hammer 34 receives a control signal on each dot line from a print hammer drive circuit 40. The drive control is effected through the print data control circuit 28.

Figure 4A:
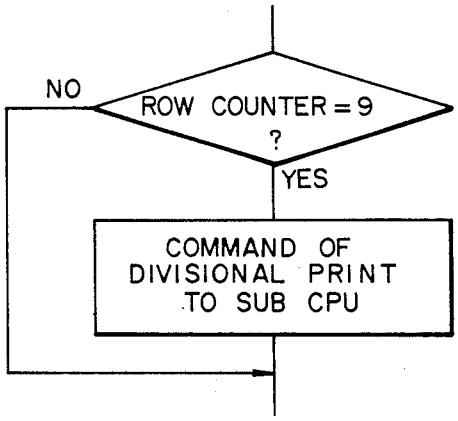
FIGS. 4(A) and 4(B) are flow charts illustrating the underline printing process in accordance with the method of the present invention as shown in FIGS. 2 and 3.
Figure 4B:
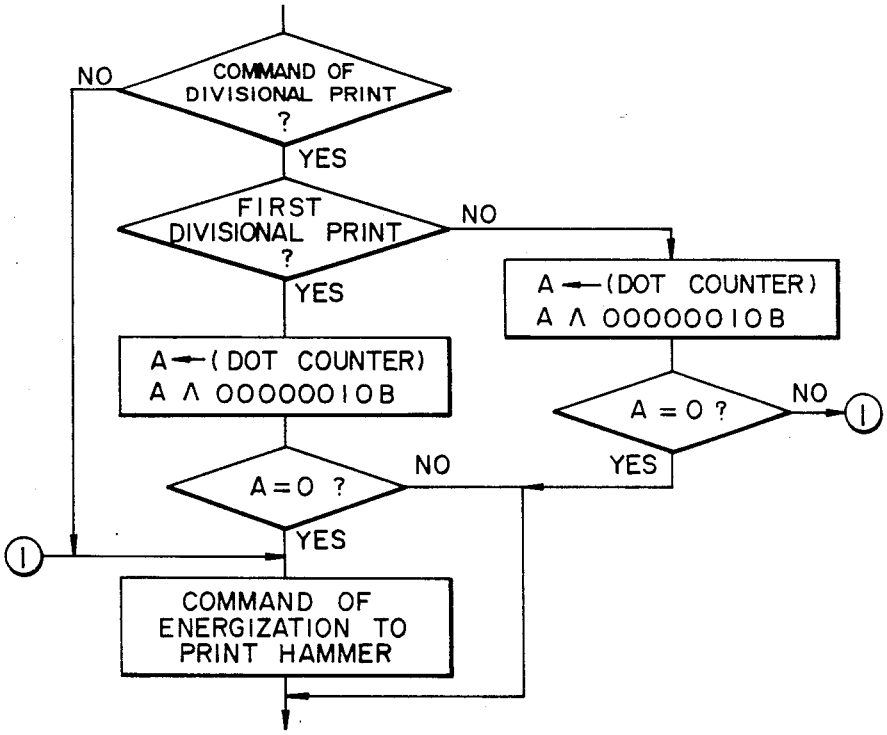

FIG. 4 shows one embodiment of the underlining process through the two travels of the print head as shown in FIG. 2. At "A", FIG. 4 shows the process through which the main microprocessor detects the requirement of underlining in consequence of whether or not the ninth dot line is to be used. In other words, if the dot line counter indicates "9", an underline print is required. As a result, the sub-microprocessor 12 will generate a command of divisional print in accordance with the present invention. If not so, the sub-microprocessor 12 will produce a command of normal non-divisional print.

At "B", FIG. 4 shows an interruption processing routine of print timing pulses with the sub-microprocessor 12. If a command of divisional print from the main microprocessor 10 is read by the sub-microprocessor 12 which in turn generates a command signal of divisional print, the motion of the print head will be divided into two travels such that the counting value of the respective dot counters will be compared and calculated with the required divided printing positions under such a condition as shown in FIG. 2.

More particularly, the first divisional printing process performs to print adjacent two dots on every four, for example, dots 1, 2, 5, 6, 9 and 10 as seen from FIG. 2. When dot count corresponding to each of these dot positions is instructed, the print hammer 34 is energized. In the second divisional printing process, the print hammer 34 is energized at positions corresponding to the remained dots 3, 4, 7, 8, 11 and 12.

In the illustrated embodiment, thus, the desired underline may be printed through two divided travels of the print head with a rest time being provided between each adjacent printings so that the power supply can sufficiently be recovered in voltage during the rest time.

Although the illustrated embodiment has been described as to two divided travels of the print head, the latter may be actuated through three or more travels if necessary.

The present invention may be applied similarly to a serial type dot printer including a single group of dot pins. The present invention also may be applied to a multi-head shuttle type dot-line printer in which dot pins are arranged on each of the first through ninth lines. In such a case, ordinary characters and underlines are simultaneously printed by a single print head. In accordance with the present invention, the dot pins for the ninth line are used to underline through a plurality of travels of the print head. On the other hand, dot pins on the first through eighth lines for printing ordinary characters are used at any time during the travels of the print head. Even in such a multi-head type printer, thus, the present invention can reduce the capacity of the power supply used therein.

We claim:

1. A method of dot-printing underlines and ruled lines which comprises:

detecting a requirement for underline or ruled line printing among the commands supplied from a host controller, the detecting of said requirement for underline or ruled line printing being achieved by means of determining whether or not a preselected dot line of a plural dot line print head is to be used in the supplied print commands, generating a command for divisional printing when said requirement for underline or ruled line printing is detected, and dividing the motion of the print head into a plurality of travels in response to the command of divisional printing so that the required underline or ruled line printing is performed by printing predetermined dots during each of a plurality of travels of the print head.

2. A method of dot-printing underline and ruled lines, which comprises detecting a requirement for underline or ruled line printing among the commands supplied from a host controller, generating a command for divisional printing when said requirement for underline or ruled line printing is detected, and dividing the motion of print head into a plurality of travels in response to the command of divisional printing so that the required underline or ruled line printing is performed by printing during each of a plurality of travels of the print head wherein said underline or ruled line printing is divided into a first divisional printing process which prints two adjacent dots out of every four and a second divisional printing process which prints the remaining dots.

* * * * *